US005953920A

United States Patent [19]

Swift et al.

[11] Patent Number: 5,953,920

[45] Date of Patent: Sep. 21, 1999

[54] TAPERED PULSE TUBE FOR PULSE TUBE REFRIGERATORS

[75] Inventors: Gregory W. Swift, Sante Fe, N.Mex.; Jeffrey R. Olson, San Mateo, Calif.

[73] Assignee: Regent of the University of California, Los Alamos, N.Mex.

[21] Appl. No.: 08/975,766

[22] Filed: Nov. 21, 1997

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,314,244 | 4/1967 | Green | 62/6 |
| 5,165,243 | 11/1992 | Bennett | 62/6 |
| 5,319,938 | 6/1994 | Lucas | 62/6 |

OTHER PUBLICATIONS

Nikolaus Rott, "The Influence of Heat Conduction on Acoustic Streaming," Journal of Applied Mathematics and Physics (ZAMP), vol. 25, pp. 417–421, 1974.

Ray Radebaugh, "A Review of Pulse Tube Refrigeration," Cryogenic Engineering Conference, pp. 1–14, 1989.

J. M. Lee, P. Kittel, K. D. Timmerhaus, R. Radebaugh, "Flow Patterns Intrinsic to the Pulse Tube Refrigerator," National Institute of Standards and Technology, pp. 125–139, 1993.

*Primary Examiner*—Ronald Capossela

*Attorney, Agent, or Firm*—Ray G. Wilson

[57] ABSTRACT

Thermal insulation of the pulse tube in a pulse-tube refrigerator is maintained by optimally varying the radius of the pulse tube to suppress convective heat loss from mass flux streaming in the pulse tube. A simple cone with an optimum taper angle will often provide sufficient improvement. Alternatively, the pulse tube radius r as a function of axial position x can be shaped with r(x) such that streaming is optimally suppressed at each x.

8 Claims, 6 Drawing Sheets

TAPERED PULSE TUBE FOR PULSE TUBE REFRIGERATORS

This invention was made with government support under Contract No. W-7405-ENG-36 awarded by the U.S. Department of Energy. The government has certain rights in the invention.

BACKGROUND OF THE INVENTION

This invention relates to refrigerators, and, more particularly, to pulse tube refrigerators.

In a simplified view of the operation of the orifice pulse tube refrigerator, the gas in the pulse tube can be thought of as a long (and slightly compressible) piston, transmitting pressure and velocity oscillations from a cold heat exchanger to an orifice at higher temperature. In this view, the gas in the pulse tube must thermally insulate the cold heat exchanger from higher temperatures. Unfortunately, this simple picture can be spoiled by convective heat transfer within the pulse tube, which carries heat from a hot heat exchanger to the cold heat exchanger and thereby reduces the net cooling power. Such convection can be steady or oscillatory, and has causes as mundane as gravity or as subtle as jetting due to inadequate flow straightening at either end of the pulse tube.

The present invention is directed toward convection driven by streaming. Streaming conventionally denotes steady convection that is superimposed on and driven by oscillatory phenomena. In the context of a pulse tube, this driving can occur in the oscillatory boundary layer at the side wall of the pulse tube where both viscous and thermal phenomena are important.

For laminar oscillatory phenomena at angular frequency $\omega$, the relevant boundary-layer thicknesses are the viscous and thermal penetration depths $\delta_\nu$ and $\delta_k$, respectively, defined by $$\delta_\nu = \sqrt{\frac{2\mu}{\omega\rho}}, \tag{1}$$

$$\delta_K = \sqrt{\frac{2K}{\omega\rho c_p}} = \delta_\nu / \sqrt{\sigma}, \tag{2}$$

where $\mu$ is the dynamic viscosity of the gas, $\rho$ is the density of the gas, $c_p$ is its isobaric specific heat per unit mass, and K is its thermal conductivity. In monatomic gases, the Prandtl number $\sigma<1$ so $\delta_\nu < \delta_K$. Much farther from the wall than these penetration depths, the oscillatory temperature of the gas in the pulse tube is essentially adiabatic, and the axial oscillatory motion parallel to the wall is essentially independent of distance from the wall. Closer to the wall, the oscillatory temperature and motion are reduced by the thermal and viscous contact with the wall; at the wall, the oscillatory temperature and motion are zero.

In order to visualize streaming that is generated within these penetration depths, consider a small parcel of gas 10 located approximately a penetration depth $\delta_\nu$ 12 from wall 14 of pulse tube 18 oscillating up and down as shown in FIG. 1A. On average, the gas between parcel 10 and wall 14 will have a different temperature during the upward motion of parcel 10 than during its downward motion, which is due to thermal contact with wall 14 and the phasing between oscillatory pressure and motion. Since the viscosity depends on temperature, moving parcel 10 will experience a different amount of viscous drag during its upward motion than during its downward motion, and hence will undergo a different displacement during its upward motion than during its downward motion. After a full cycle, parcel 10 does not return to its starting point; it experiences a small net drift 16. Streaming is the sum of many processes, but this explanation provides an intuitive explanation for one such process.

Drifting parcel 10 close to wall 14 has a profound effect on all the gas in pulse tube 18 because it drags gas farther from wall 14 along with it. In the usual case, with pulse tube 18 radius much larger than penetration depth $\delta_\nu$ 12, an offset parabolic streaming velocity profile 22 results, shown in FIG. 1B. Gas parcel 10 has a velocity near the wall equal to the drift velocity just outside penetration depths 12, and has a velocity in the center 24 of the pulse tube determined by the requirement that the net mass flux along the tube must be zero.

The effect of parabolic-streaming profile 22 is shown in prior art pulse tube refrigerator 30 in FIG. 1C. Pulse tube refrigerator 30 includes hot heat exchangers 32 and 36, regenerator 34, cold heat exchanger 38, flow straightener 42, compliance volume 44, orifice valve 46, and pulse tube 48. The parabolic-streaming profile 22 shown in FIG. 1B produces a toroidal convection cell 50 that convects heat from hot heat exchanger 36 to cold heat exchanger 38. The toroidal velocity is much smaller than the oscillatory velocity that causes it.

Hence, oscillatory processes roughly a penetration depth from the wall cause a steady axial drift approximately a penetration depth away from the wall. This, in turn, establishes an offset parabolic mass-flux profile across the entire tube that convects heat.

The problem of heat convection caused by streaming is recognized in J. M. Lee et al., "Flow Patterns Intrinsic to the Pulse Tube Refrigerator", Proceedings of the $7^{th}$ International Cryocooler Conference, pp. 125–139 (1993). In their final two paragraphs, Lee et al. discuss two methods for reducing this streaming: controlling the mass flow at the warm end of the pulse tube and using a tapered pulse tube configuration. It is suggested that the tapered pulse tube have a monotonic spatial variation in the pulse tube radius to reduce velocity amplitude differences. But there is no teaching on how to select an appropriate taper angle, nor is there presented any experimental evidence regarding a tapered pulse tube.

Accordingly, it is an object of the present invention to minimize or eliminate streaming mass flux near a pulse tube wall.

It is another object of the present invention to increase the cooling power of an orifice pulse tube refrigerator significantly by shaping the radius of a pulse tube wall along the axis of the pulse tube.

Yet another object of the present invention is to define an optimum taper angle of a pulse tube wall to suppress mass flow streaming.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a pulse-tube refrigerator where thermal insulation of the pulse tube is maintained by optimally varying the radius of the pulse tube to suppress convective heat loss from mass flux streaming in the pulse tube. A simple cone with an optimum taper angle will often provide sufficient improvement. Alternatively, the pulse tube radius r as a function of axial position x can be shaped with r(x) such that streaming is optimally suppressed at each x.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

In accordance with the present invention, thermal insulation of the pulse tube in a pulse-tube refrigerator is maintained by optimally varying the area of the pulse tube to suppress convective heat loss from mass flux streaming in the pulse tube. A simple cone with an optimum taper angle will often provide sufficient improvement. Alternatively, the pulse tube radius r as a function of axial position x can be shaped with r(x) such that streaming is optimally suppressed at each x.

A general method for calculating streaming is published in N. Rott, "The influence of heat conduction on acoustic streaming", *Z. Angew. Math. Phys.,* 25:417 (1974) for the case of axially varying wall temperature, in the boundary layer limit with standing wave phasing between pressure and velocity and with constant tube cross-sectional area. Standing wave phasing is a poor assumption for the pulse tube in an orifice pulse tube refrigerator, because significant acoustic power flows along the pulse tube. In accordance with the present invention, a new analysis is developed that follows Rott's method, but incorporates variable cross-section and arbitrary phase between pressure and velocity.

Figure 1A:
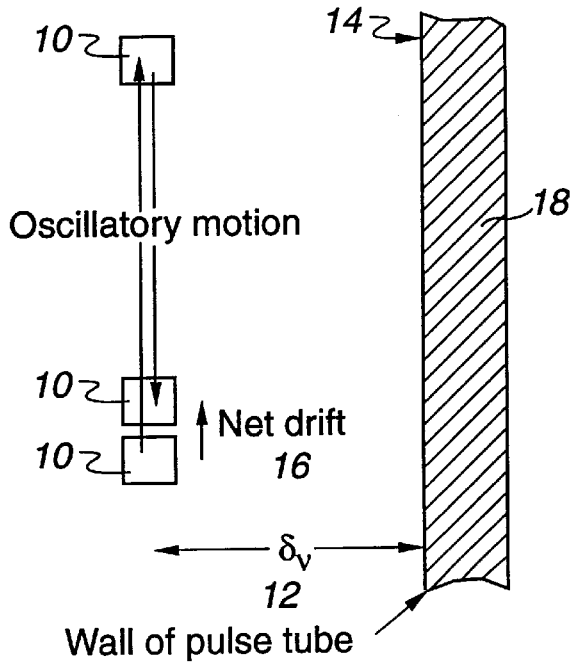
Fig. 1A (Prior Art)
FIG. 1A schematically shows movement of a gas parcel adjacent a pulse tube wall.
Figure 1B:
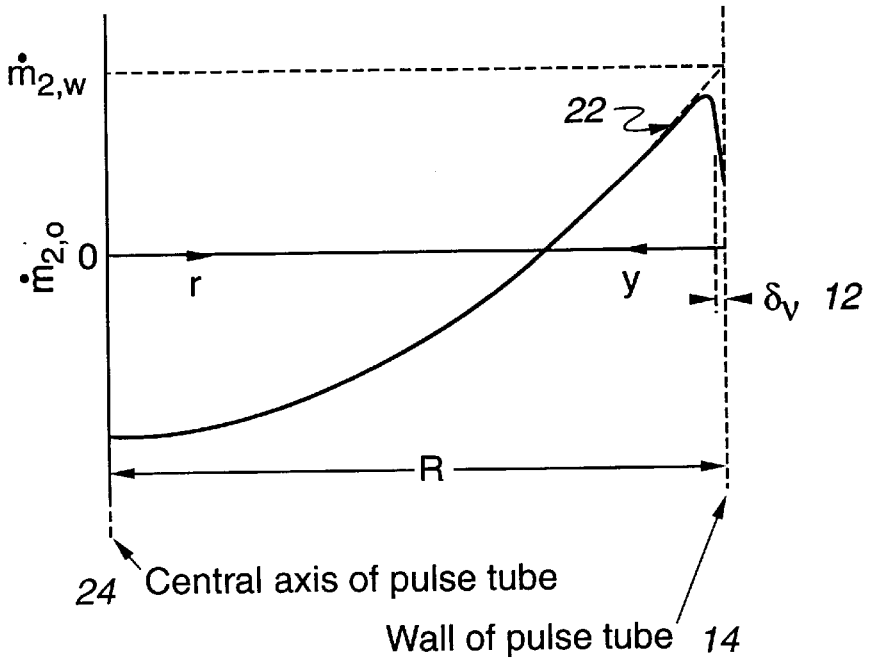
Fig. 1B (Prior Art)
FIG. 1B graphically depicts the radial distribution of mass flux within a prior art pulse tube.
Figure 1C:
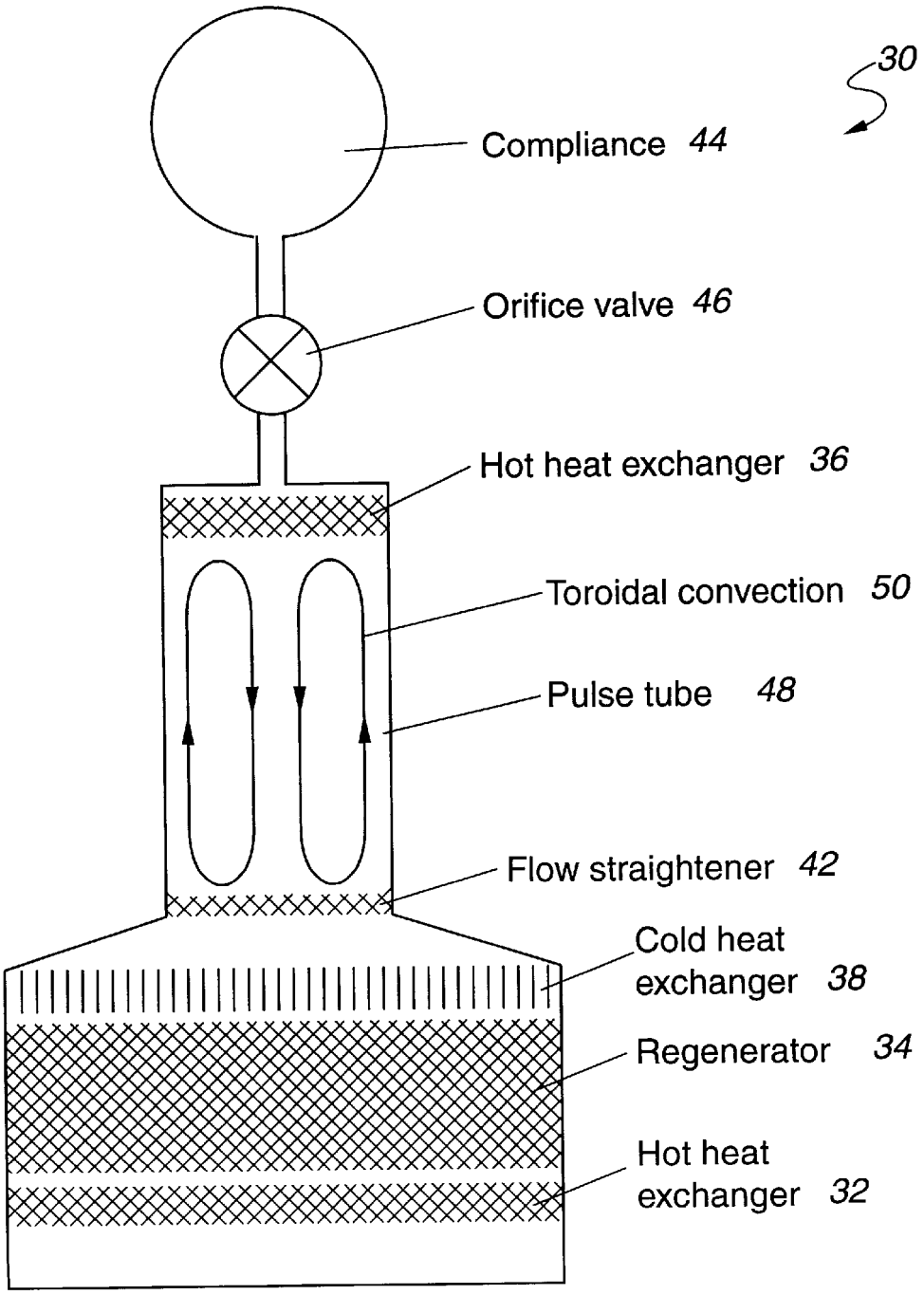
Fig. 1C (Prior Art)
FIG. 1C is a cross-section of a conventional pulse tube refrigerator to illustrate toroidal convection within the pulse tube.

For ideal gases, $p=\rho R_g T$ and $\rho\alpha^2=\gamma p$, where p is the pressure, $R_g$ is the gas constant, T is the temperature, $\alpha$ is the speed of sound, and $\gamma$ is the ratio of heat capacity at constant pressure to heat capacity at constant volume. The geometry used in this analysis is shown in FIG. 1B, although the details of the geometry are largely unimportant. The relevant variables are expanded to second order:

$$u(x,y,t)=Re[u_1(x,y)e^{i\ \omega]+u}{}_{2,0}(x,y) \tag{3}$$

$$v(x,y,t)=Re[v_1(x,y)e^{i\ \omega t}]+v_{2,0}(x,y) \tag{4}$$

$$T(x,y,t)=T_m(X)+Re[T_1(x,y)e^{i\ \omega t}]+T_{2,0}(x,y) \tag{5}$$

$$\rho(x,y,t)=\rho_m(X)+Re[\rho_1(x,y)e^{i\ \omega t}]+\rho_{2,0}(x,y) \tag{6}$$

$$p(x,t)=P_m+\mathrm{Re}[p_1(x)e^{i\ \omega t}]+p_{2,0}(x,y) \tag{7}$$

$$\mu(x,y,t)=\mu_m(X)+Re[\mu_1(x,y)e^{i\ \omega t}]+\mu_{2,0}(x,y) \tag{8}$$

where u and v are the axial and lateral components of the velocity, $\mu$, is the viscosity, x is the axial position, $\gamma$ is the lateral distance from the wall, t is the time, and Re[z] denotes the real part of z.

In this notation, the variables with subscript "m" are steady-state mean values, without time dependencies; these represent the values that the variables would have if there were no oscillating pressure or velocity. The mean temperature profile $T_m(x)$ is assumed to be known, and leads to the x dependence of $\rho_m$ and $\mu_m$. The subscript "m" is hereinafter omitted on constant properties (such as $c_p$ and $\gamma$) and on variables for which terms of order higher than mean are unimportant for the present analysis (such as $\alpha$ (speed of sound) and K (thermal conductivity)).

The subscript "1" indicates the first-order part of each variable, which accounts for oscillation at angular frequency $\omega$. The first-order variables are complex quantities, having both magnitude and phase to account for their amplitudes and time phasing. For purposes of this analysis, the oscillating pressure $P_1$ and the lateral spatial average ($u_1$) of the oscillating axial velocity $u_1$ are assumed to be known, as they are experimentally accessible through measurements of oscillating pressure in the pulse tube and mass flow through the orifice. Expressions for the other oscillating variables (temperature, density, etc.) in terms of $p_1$ and ($u_1$) are well known. To make the problem more tractable, the tube radius is assumed to be much larger than the viscous and thermal penetration depths, defined by Equations (1) and (2), respectively.

The dependence of pressure on y is negligible, either in the boundary layer limit, or when y dimensions are much smaller than the acoustic wavelength. Consequently, the pressure is given as a function of x only. Surprisingly, the oscillatory part of the viscosity cannot be neglected. It is assumed to be independent of pressure and to depend on the oscillatory temperature via the temperature dependence of the viscosity, which takes the form $$\mu(T)=\mu(T/T_0)^b. \tag{9}$$

Second-order, time-independent parts of variables are indicated by the subscript "2,0". These include the axial streaming velocity $u_{2,0}$, which is of interest herein. The complete expansion to second order would also include terms such as $\mathrm{Re}[u_{2,2}(x,y)e^{i\ \omega t}]$, with subscript "2,2" indicating second order and $2\omega$ time dependence; but these are ignored herein as they have negligible influence on the terms above and on the experimental results.

When variables as in Equations (5)–(8) are expanded, the first-order terms are of order M×(mean value), and the second-order terms are of order $M^2$×(mean value), where $M=|u_1|/a \sim |p_1|/p_m$ is the Mach number and $|z|$ denotes the magnitude of the complex variable z. The lowest-order energy fluxes are of order $M^2$, and streaming might be expected to contribute an energy flux only of order $M^4$, due to terms such as $\rho_m c_p T_{2,0}\ u_{2,0}$. In the case of the pulse tube, however, a streaming velocity $u_{2,0}$, which is indeed of order $M^2 \times a$, can lead to a large $T_{2,0}$, of the same order as the temperature spanned by the pulse tube instead of $M^2$ times the temperature spanned. Consequently, streaming can carry an appreciable amount of heat from the hot to the cold end of the refrigerator, reducing its coefficient of performance.

By substituting Equations (3)–(9) into the equations of motion, continuity, and heat transfer for gases, we have shown that the streaming mass flux density just outside the penetration depths is given by $$\dot{m}_{2,w} = \frac{|p_1||\langle u_1\rangle|}{a^2}\left[\left(\frac{3}{4} + \frac{(\gamma-1)(1-b\sigma^2)}{2\sigma(1+\sigma)}\right)\cos\theta + \left(\frac{3}{4} + \frac{(\gamma-1)(1-b)\sqrt{\sigma}}{2(1+\sigma)}\right)\sin\theta\right] + \frac{\rho_m|\langle u_1\rangle|^2}{\omega}\left[\frac{3}{4}\frac{dA/dx}{A} + \frac{(1-b)(1-\sqrt{\sigma})}{4(1+\sigma)(1+\sqrt{\sigma})}\frac{dT_m/dx}{T_m}\right] \tag{10}$$

where θ is the phase angle by which $(u_1)$ leads $p_1$, b is $(T_m/\mu_m)(d\mu_m/dT_m)$, A is the area of the pulse tube, and x is the axial distance from the cold end of the pulse tube. The streaming profile far from the wall is then given by $$\dot{m}_{2,0}(r) = \dot{m}_{2,w}\left(\frac{2r^2}{R^2} - 1\right), \tag{11}$$

where r is the radial coordinate and R is the radius of the pulse tube, as illustrated in FIG. 1B. To display the boundary-layer behavior clearly, the figure does not have $R \gg \delta_\nu$, and hence the maximum of $\dot{m}_{2,0}$ falls short of $\dot{m}_{2,w}$ in the Figure. Note, however, that calculations herein are valid only for $R \gg \delta_\nu$, where the maximum of $\dot{m}_{2,0} \cong \dot{m}_{2,w}$. The convention adopted herein is that x increases toward the hot end of the pulse tube, so that $0 \leqq \theta \leqq \pi/2$ in the pulse tube of a traditional orifice pulse tube refrigerator.

Several things are worth noting about Equation (10). First, the coefficient of $dT_m/dx$ is rather small for helium, an exemplary pulse tube medium, so that streaming depends only weakly on the temperature gradient. This is fortunate for two reasons: the optimally tapered pulse tube described below remains optimal over a wide range of operating conditions and details of the actual axial temperature profile (generally deviating significantly from linear dependence on x) are of only minor significance.

Second, the coefficients of the other terms in Equation (10) are of similar magnitude, so neglect of the temperature dependence of viscosity, of thermodynamic effects (i.e., $\gamma \neq 1$), or of the phase between $p_1$ and $(u_1)$ leads to significant error. In particular, inclusion of the temperature dependence of viscosity ($b \neq 0$) is important.

Third, $\dot{m}_{2,w}$ diverges as $1/\sigma$, so gas mixtures with small values of ρ will have higher streaming mass flux.

Fourth, it is sometimes possible to make $\dot{m}_{2,w}=0$ by proper choice of the phase between $p_1$ and $(u_1)$. In a traditional orifice pulse tube refrigerator, this is not possible since $0 \leqq \theta \leqq \pi/2$. However, when inertance (see, e.g., U.S. patent application Ser. No. 08/853,190, filed May 7, 1997, by Swift et al.) is used to provide more efficient phasing in an orifice pulse tube refrigerator, θ can be negative, so that streaming might thereby be suppressed in an ordinary pulse tube.

Fifth, in accordance with our invention, streaming can also be eliminated by using an appropriately shaped pulse tube, so that the dA /dx term in Equation (10) cancels the sum of the other terms at each value of x. Setting Equation (10) equal to zero, streaming is eliminated in a tapered pulse tube if $$\frac{1}{A}\left(\frac{dA}{dx}\right) = -\frac{\omega|p_1|}{\gamma p_m|\langle u_1\rangle|}\left[\left(1 + \frac{2(\gamma-1)(1-b\sigma^2)}{3\sigma(1+\sigma)}\right)\cos\theta + \left(1 + \frac{2(\gamma-1)(1-b)\sqrt{\sigma}}{3(1+\sigma)}\right)\sin\theta\right] - \frac{(1-b)(1-\sqrt{\sigma})}{3(1+\sigma)(1+\sqrt{\sigma})}\frac{dT_m/dx}{T_m} \tag{12}$$

$$\cong -\frac{\omega|p_1|}{p_m|\langle u_1\rangle|}(0.75\cos\theta + 0.64\sin\theta) - 0.0058\frac{dT_m/dx}{T_m} \tag{13}$$

In Equation (13), the numerical values correspond to low-temperature helium gas: $\gamma=5/3$, $\sigma \cong 0.69$, $b \cong 0.68$. For this value of dA/dx, the parabolic part of the velocity profile shown in FIG. 1B is eliminated; the only nonzero streaming occurs at distances from the wall comparable to the penetration depths.

Using this analysis, it is found that velocity amplitude differences along the pulse tube cannot be wholly eliminated because of phase variation in velocity along the tube. According to Lee et al.'s suggestion that velocity amplitude differences be minimized, the best minimization of velocity amplitude differences would occur for a taper of $$\frac{1}{A}\frac{dA}{dx} = -\frac{\omega|p_1|}{\gamma p_m|\langle u_1\rangle|}\sin\theta \tag{14}$$

using the analysis presented herein. Comparison of Equation (14) with Equations (12) and (13) shows that the idea proposed by Lee et al. captures only a small part of the effects embodied in Equations (12) and (13), which additionally include velocity phase variation, viscous shear at the wall, temperature dependence of viscosity, and thermal relaxation at the wall. All these phenomena must be considered simultaneously to arrive at the correct taper, as shown by Equations (12) and (13).

The derivation of Equations (12) and (13) is based on the assumption that the flow is laminar, but for sufficiently high velocity, turbulence will probably invalidate the results. The results should be applicable in the weakly turbulent regime as well as in the laminar region, because in the weakly turbulent regime, the turbulence is generated outside the penetration depth, leaving the velocity close to the wall at nearly the same velocity as it would be for laminar flow. Data from seven pulse-tube refrigerators showed that all seven operate in the weakly turbulent regime, where this analysis is expected to be valid. However, it is likely that the quantitative details of streaming-driven convention in the conditionally turbulent and fully turbulent regimes differ greatly from the results presented here, because, in these regimes, the turbulence has a dramatic influence on the gas velocity within the penetration depth.

Although the energy flux density $\dot{m}_{2,0}c_pT_{2,0}$ convected by this streaming is formally of the fourth order, it can in practice be as large as a typical second-order energy flux density, because $T_{2,0}$ can be of the order of the temperature difference between the two ends of the pulse tube when $R \gg \delta_k$. Accurate calculation of this heat flux density would require significant additional effort, because the weak turbulence in typical pulse tubes may enhance the lateral heat transfer between the upward and downward streaming currents, reducing $T_{2,0}$ and making accurate calculation of $T_{2,0}$ difficult. In fact, with such large $T_{2,0}$, the entire perturbation expansion presented here is essentially invalid except when taper or phasing makes $\dot{m}_{2,w}$ (and thus $T_{2,0}$) very small, the region of interest herein.

There are numerous other fourth-order energy flux terms in addition to the two contained in $\dot{m}_{2,0}c_pT_{2,0}$ that would in principle have to be considered to obtain a formally correct fourth-order result. Fortunately, the only other large term, $(\frac{1}{2})\rho_{2,0}c_p\,\mathrm{Re}[T_1<(\tilde{u}_1<)]$, is zero at the same taper angle that makes $T_{2,0}$ zero, while the remaining terms, such as those involving products of first and third order quantities, are small for all angles.

To verify Equation (13), an orifice pulse tube refrigerator was tested with three pulse tubes: a right-circular cylinder, a truncated cone with the optimum angle determined by Equation (13), and a second truncated cone with about twice the optimum angle. The large angle cone should induce the same streaming velocity and convection as the cylindrical pulse tube, but in the opposite direction, and, so, should exhibit about the same performance as the cylindrical pulse tube according to the relationships of our invention.

Figure 2:
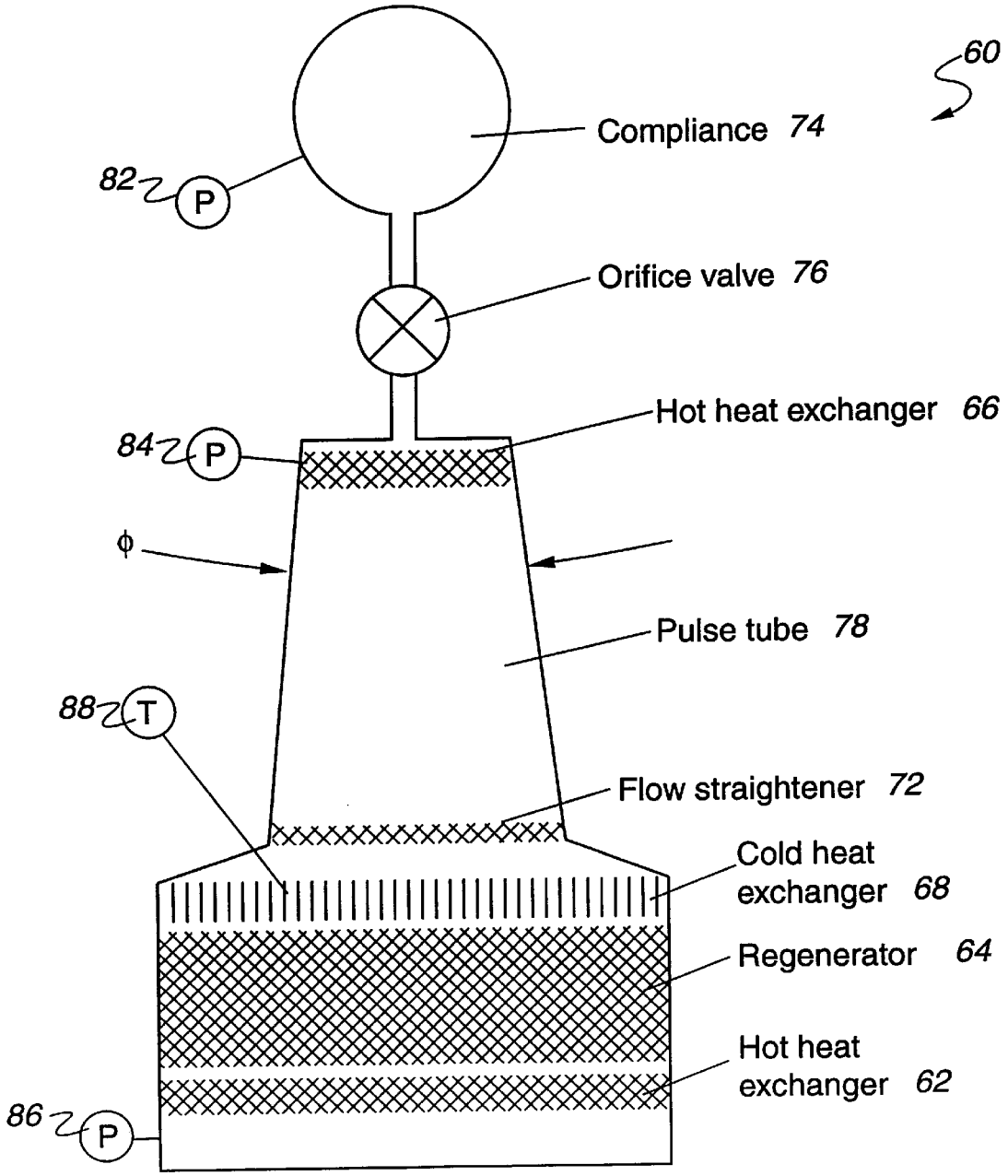
FIG. 2 is a cross-section of a pulse tube refrigerator according to one embodiment of the present invention.

Pulse tube refrigerator 60 is shown schematically in FIG. 2. It was filled with 3.1 MPa helium and driven at 100 Hz by a thermoacoustic engine similar to one described in G. W. Swift, "Analysis and performance of a large thermoacoustic engine", 92 J. Acoust. Soc. Am. 1563 (1992), incorporated herein by reference. The test system was assembled for proof-of-principle tests and was not optimized.

The entire apparatus beyond the hot end 62 of regenerator 64 was contained within a vacuum can where the pressure was $10^{-5}$ torr. All cold parts were also wrapped in several layers of aluminized mylar superinsulation. Regenerator 64 was 4.6 cm in diameter, 3.0 cm long, and made of No. 325 stainless-steel screens with 28 $\mu$m wire diameter. The two hot temperature heat exchangers 62, 66 were stacked copper screens soldered into copper blocks through which 15° C. cooling water flowed. Cold heat exchanger 68 consisted of parallel copper plates. Flow straightener 72 was simply four layers of No. 40 stainless-steel screen. Compliance 74 (i.e., reservoir volume) was a steel bulb with a volume of 150 $cm^3$. Orifice 76 was a needle valve that could be adjusted from outside the vacuum can (not shown).

Three pulse tubes 78 were formed from stainless steel with a wall thickness of 0.5 mm, a length of 4.65 cm, and a volume of 11.0 $cm^3$. Hence, the cylinder had R=8.7 mm, much larger than $\delta_\nu$=80 $\mu$m and $\delta_\kappa$=97 $\mu$m at 200 K, which are, in turn, much larger than the 1 $\mu$m roughness of the inner surfaces of the pulse tubes. The optimum-taper pulse tube was built according to Equation (13), which gave $(1/A)dA/dx=-0.056\ cm_{-1}$. This is equivalent to a total included angle $\phi$ of 0.049 rad=2.8°, with the cold end larger than the hot end. This is a small enough angle that it is barely discernible by eye. The double-angle pulse tube had an angle of 0.103 rad=5.9°. In both cases, the internal diameter at each end was calculated in order to make the volume of the pulse tube the same as in the cylindrical case.

The oscillating pressure amplitude was measured with piezoresistive sensors 82, 84, 86 in compliance 74 and near the two hot heat exchangers 66, 62, respectively. The temperature of the cooling water in the hot exchangers was measured with thermocouples, and thermocouple 88 was inserted directly into the gas space of cold heat exchanger 68 to measure the cold gas temperature $T_c$.

Heat $Q_{cold}$ sold was optionally applied to the cold stage with a resistive heater (not shown). The resistance of the heater and the applied voltage were measured to determine the applied power.

The experimental operating conditions were determined as follows. The drive amplitude and orifice setting were selected experimentally by minimizing the cold gas temperature at zero applied heat load with the cylindrical pulse tube, without overloading the thermoacoustic driver (which operated near its high-temperature limit throughout the experiments). This determined the operating point that was reproduced for all the data shown in this work: $|p_1|=2.32\times10^5$ Pa at heat exchanger 62 and $|p_1|=0.59\times10^5$ Pa in compliance 74. Under these conditions, $|p_1|$ at heat exchanger 66 at the hot end of the pulse tube was always within 0.5% of $1.95\times10^5$ Pa.

These operating conditions, along with the refrigerator geometry, were used to calculate the magnitudes and relative phases of $P_1$ and $<u_1>$ at the ends and in the middle of pulse tube 78. These calculated values were used in Equation (13) to determine the optimum dA/dx at the ends and in the middle of pulse tube 78. The values were such that a simple cone (as described above) was a reasonable approximation to the ideal shape, making more difficult fabrication unnecessary. The resulting cone angle $\phi$ was also shallow enough to eliminate concerns about flow separation at the wall.

Figure 3:
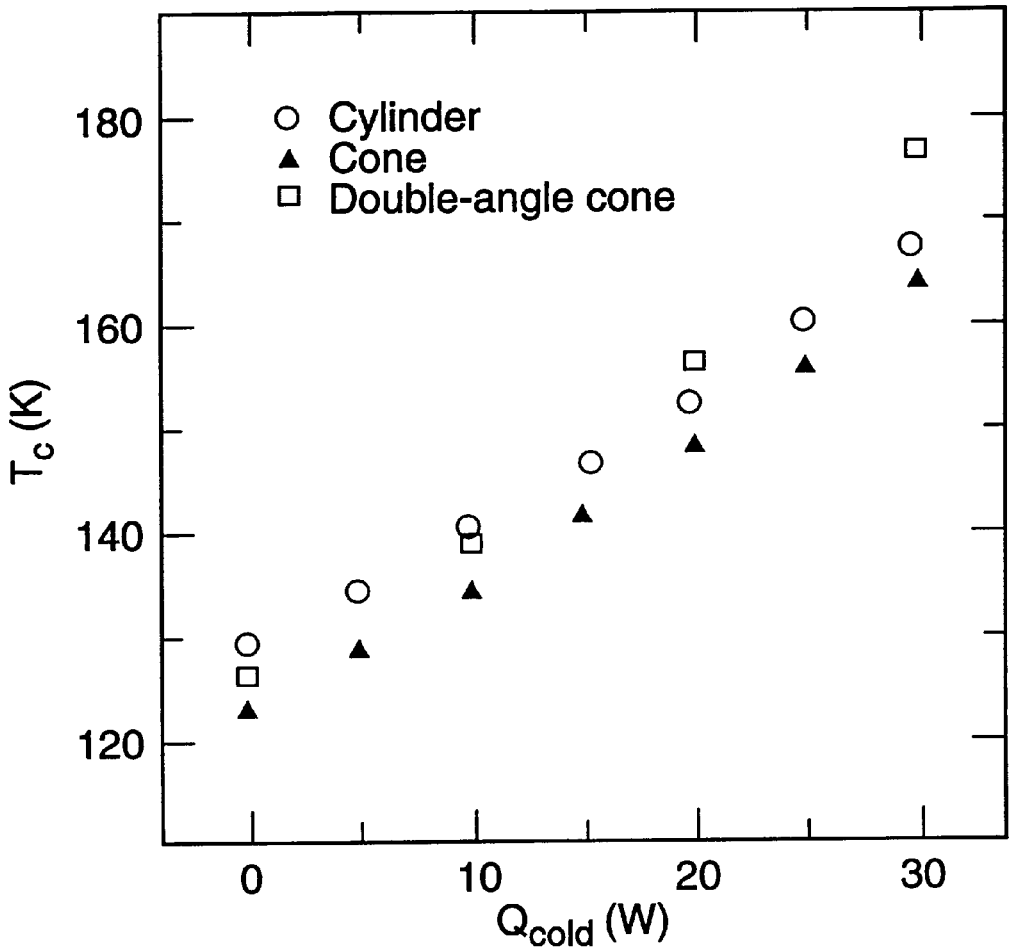
FIG. 3 graphically compares the performance of pulse tubes with no taper, an optimum taper, and twice the optimum taper.

Experimental results are shown in FIG. 3. The data corresponding to the cylindrical pulse tube are represented by the circles, while those of the optimum-angle (2.8°) conical pulse tube are shown as triangles and those of the double-angle (5.9°) cone as squares. For all three pulse tubes, the temperature of the gas increases as more heat is applied to the cold stage, as expected. For all measured values of applied heat, the temperature corresponding to the optimum cone pulse tube is at least 5° C. colder than the temperatures with either the cylindrical or the double-angle pulse tubes, indicating that the optimum cone performs significantly better than the other pulse tubes. From an alternative point of view, it appears that the streaming-driven convective heat load on the cold heat exchanger is 3 to 5 W greater with the cylindrical and double-angle pulse tubes than with the optimally tapered pulse tube.

A second verification of Equation (13) was provided by a much larger pulse tube refrigerator with a single tapered pulse tube and a variable acoustic impedance, which was tested at five selected operating points. This refrigerator used 3.1 MPa helium gas at 40 Hz. Its measured net cooling power ranged from 1070 W to 1690 W at these operating points, with $|p_1|=2.1\times10^5$ Pa at the hot end of the pulse tube in all five cases.

In pulse tube refrigerator design and operation, Re[Z] and Im[Z] are important variables, where Z is the acoustic impedance at the hot end of the pulse tube. Experimentally, selected values of Re[Z] and Im[Z] can be reached by adjustment of the two valves in the impedance network above the hot end of the pulse tube, as taught by Swift and Gardner in U.S. patent application Ser. No. 08/853,190, "Pulse tube refrigerator with variable phase shift", and by Gardner and Swift in "Use of inertance in orifice pulse tube refrigerators", Cryogenics, Volume 37, pages 117–121 (1997). In the design of the present pulse tube refrigerator, the design operating point, shown as the open circle in FIG. 4A, was selected theoretically based on the desired cooling power and the optimized phasing between pressure and velocity in the regenerator. Analysis using Equation (13) showed that operating points along the line marked "straight" would have zero streaming-driven convection if a straight pulse tube were built. It was judged that the design operating point was too far from this line, so the pulse tube was built using Equation (13)for the design operating point, with a taper $(1/A)dA/dx=-0.49\ m^{-1}$ which was equivalent to a total included $\phi$ of 1.3° with the cold end larger than the hot end. Further analysis using Equation (13) showed that all operating points on the line marked "as built" would have zero streaming-driven convection with this taper. The five selected experimental operating points, shown as filled circles and labeled "1" through "5", were chosen to be close to the design operating point and close to the "as-built" line of possible operating points. It was predicted that experimental operating points farthest from this line would exhibit the greatest streaming-driven convective heat transfer.

To detect the presence of this convective heat transfer, all parts of the pulse-tube refrigerator were thermally insulated, except for the fluid streams in contact with the heat exchangers. Hence, measurement of the heat carried away from the heat exchanger at the hot end of the pulse tube was a direct measurement of the total energy flow $\dot{H}$ up the pulse tube. Pressure sensors in the compliance and at the hot end of the pulse tube allowed measurement of the acoustic power flow $\dot{W}$ up the pulse tube, via a simple method known by most practitioners of pulse-tube refrigeration, and as taught incidentally by Swift and Gardner and by Gardner and Swift mentioned above. In the absence of any heat transfer in the pulse tube (due to conduction, convection, or radiation), $\dot{H}=\dot{W}$, so the deviation of $\dot{H}/\dot{W}$ from unity is a measure of such undesired heat transfer, which directly reduces the net cooling power of the refrigerator. Hence, this ratio is commonly known as the figure of merit for a pulse tube. In prior-art pulse tube refrigerators, the pulse tube figure of merit has typically been in the range from 0.6 to 0.85.

Figure 4A:
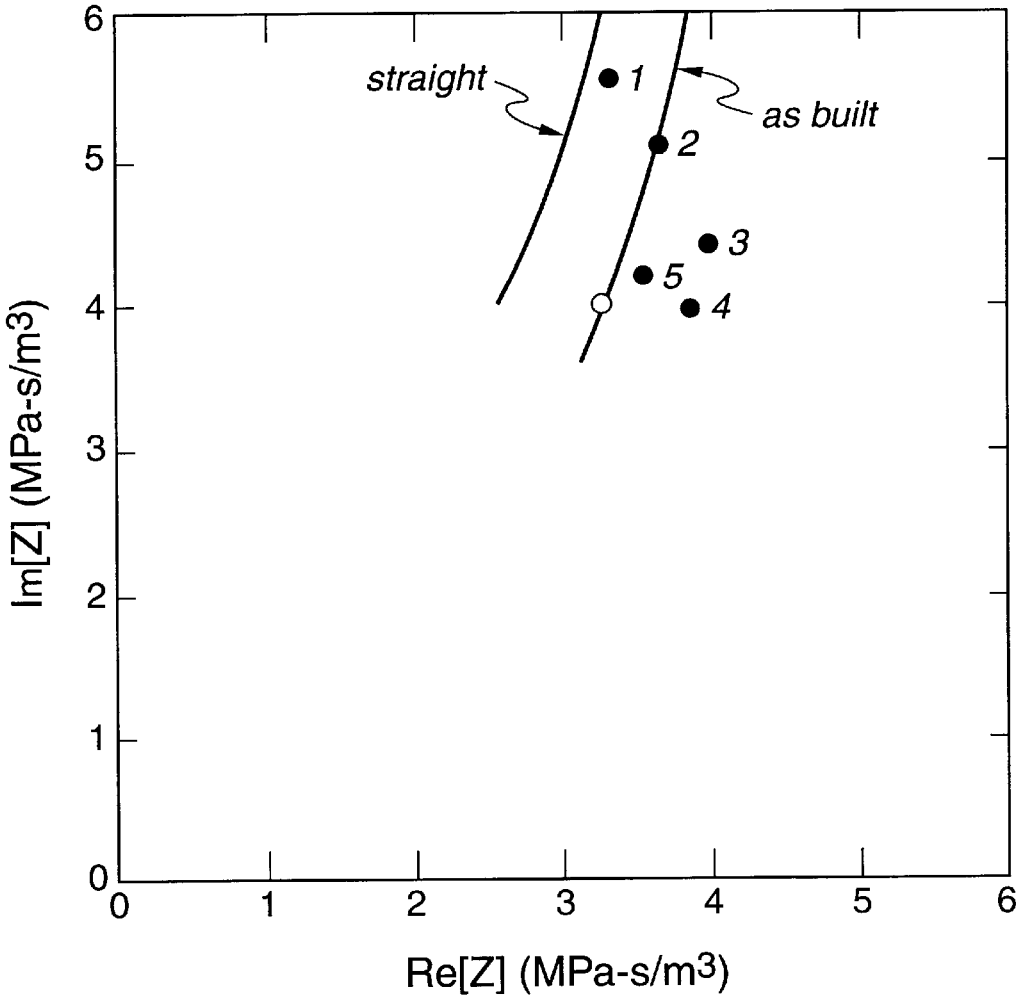
FIG. 4A graphically shows selected operating points of a pulse tube refrigerator according to a second embodiment of the present invention.
Figure 4B:
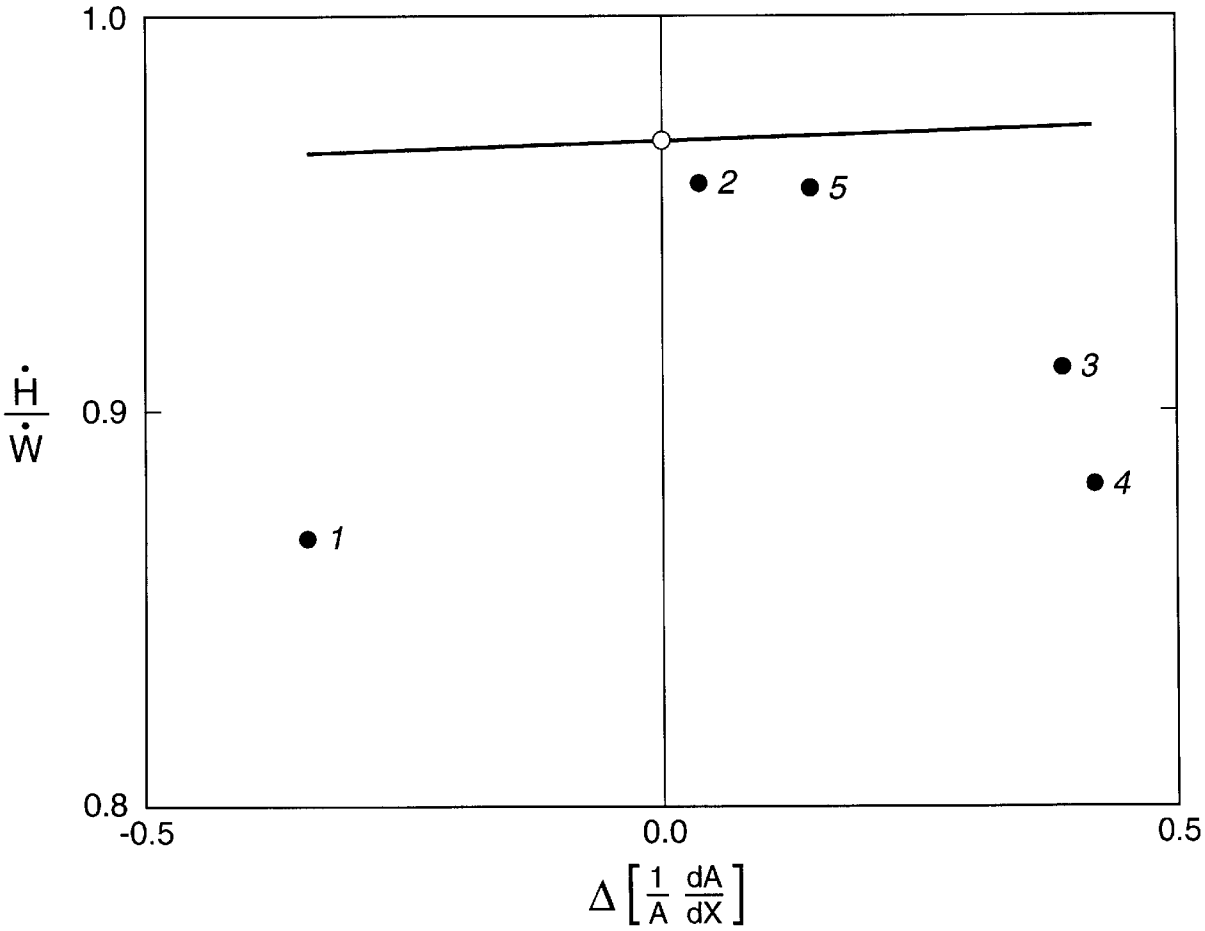
FIG. 4B graphically compares the performance of a pulse tube refrigerator operated at various distances from a design operating point for which its taper was designed.

FIG. 4B shows the experimental values of $\dot{H}/\dot{W}$ for the five selected operating points, displayed vs. how far those operating points are from possible operating points of predicted zero streaming-driven convection shown as the "as built" line in FIG. 4A. To provide a quantitative measure of this distance, the horizontal axis is the difference between the "as-built" value of (1/A)dA/dx and the value that Equation (13) yields for (1/A)dA/dx at the selected operating point. Operating points 2 and 5, which are closest to the "as built" optimal condition, have the highest value of $\dot{H}/\dot{W}$, approximately 0.96. Based on the lower values of $\dot{H}/\dot{W}$ for the other three operating points, operating points 2 and 5 are estimated to yield an experimental value of $\dot{H}/\dot{W}$ near or below 0.85 if the pulse tube had been straight instead of being tapered according to Equation (13).

The line in FIG. 4B near $\dot{H}/\dot{W}=0.97$ shows calculated values of $\dot{H}/\dot{W}$ including only thermal conductivity in the stainless-steel pulse tube wall and thermoacoustic boundary-layer heat transport, but not including the streaming-driven convection that is the focus of the present invention. As in FIG. 4A, the design operating point is shown as an open circle.

Equation (14), based on the work of Lee et al., yields (1/A)/dA/dx=1.5 $m^{-1}$ for the design operating point. This taper, with hot end larger than cold end (opposite the taper required by our analysis), is very far from the (1/A)dA/dx=−0.49 $m^{-1}$ described here.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A pulse tube refrigerator using an oscillating working fluid to transfer heat within the refrigerator, including:

a regenerator containing the oscillating working fluid and having a hot heat exchanger on a first side and a cold heat exchanger on a second side to provide refrigeration;

a second hot heat exchanger connected to an orifice and compliance for adjusting parameters of the oscillating working fluid;

wherein the improvement comprises a tapered pulse tube connecting the cold heat exchanger and the second hot heat exchanger and having a cross-sectional area variation effective axially between the cold heat exchanger and the second hot heat exchanger to minimize heat loss through streaming-driven convection of the oscillating working fluid to thermally isolate the cold heat exchanger from the hot heat exchanger.

2. A pulse tube refrigerator according to claim 1, wherein the cross-sectional area variation is defined by an equation, $$\frac{1}{A}\left(\frac{dA}{dx}\right)=-\frac{\omega|p_1|}{\gamma p_m|\langle u_1\rangle|}\left[\left(1+\frac{2(\gamma-1)(1-b\sigma^2)}{3\sigma(1+\sigma)}\right)\cos\theta+\left(1+\frac{2(\gamma-1)(1-b)\sqrt{\sigma}}{3(1+\sigma)}\right)\sin\theta\right]-\frac{(1-b)(1-\sqrt{\sigma})}{3(1+\sigma)(1+\sqrt{\sigma})}\frac{dT_m/dx}{T_m},$$

where $(u_1)$ is the lateral spatial average of the oscillating axial velocity $u_1$, $T_m$ is the steady-state mean temperature profile, $p_m$ is the steady-state pressure, $p_1$ is the oscillating pressure, $\theta$ is the phase angle by which $(u_1)$ leads $p_1$, b is $(T_m/\mu_m)(d\mu_m/dT_m)$, $\gamma$ is the ratio of heat capacity at constant pressure to heat capacity at constant volume, $\omega$ is the angular frequency of oscillation, $\sigma$ is the Prandtl number, $\mu_m$ is the steady-state viscosity, A is the cross-sectional area of the pulse tube, and x is the axial distance from the cold end of the pulse tube.

3. A pulse tube refrigerator according to claim 2, where the equation defines a radius at two locations within the pulse tube that are connected by a straight line to define a constant taper angle for the pulse tube.

4. A method for reducing convective heat load from flow streaming in a pulse tube of a pulse tube refrigerator having an oscillating working fluid for moving heat from a cold heat exchanger to a hot heat exchanger separated from the cold heat exchanger by the pulse tube comprising the steps of:

determining the steady-state and oscillating parameters for the oscillating working fluid and pulse tube refrigerator; and inputting the steady state and oscillating parameters into the equation of claim 2 to determine a profile for the cross-sectional area of the pulse tube.

5. A method according to claim 4, including the step of applying the equation of claim 2 to determine the cross-sectional area of the pulse tube at two locations within the pulse tube to define an angle for tapering the pulse tube.

6. A pulse tube for use in a pulse tube refrigerator having a cross-sectional area variation effective to minimize heat loss through streaming-driven convection within the pulse tube.

7. A pulse tube according to claim 6, wherein the cross-sectional area variation is defined by an equation, $$\frac{1}{A}\left(\frac{dA}{dx}\right) = -\frac{\omega\,|p_1|}{\gamma p_m\,|\langle u_1\rangle|}\left[\left(1+\frac{2(\gamma-1)(1-b\sigma^2)}{3\sigma(1+\sigma)}\right)\cos\theta + \left(1+\frac{2(\gamma-1)(1-b)\sqrt{\sigma}}{3(1+\sigma)}\right)\sin\theta\right] - \frac{(1-b)(1-\sqrt{\sigma})}{3(1+\sigma)(1+\sqrt{\sigma})}\,\frac{dT_m/dx}{T_m},$$

where $(u_1)$ is the lateral spatial average of the oscillating axial velocity $u_1$, $T_m$ is the steady-state mean temperature profile, $p_m$ is the steady-state pressure, $p_1$ is the oscillating pressure, $\theta$ is the phase angle by which $(u_1)$ leads $p_1$, b is $(T_m/\mu_m)(d\mu/dT_m)$, $\gamma$ is the ratio of heat capacity at constant pressure to heat capacity at constant volume, $\omega$ is the angular frequency of oscillation, $\sigma$ is the Prandtl number, $\mu_m$ is the steady-state viscosity, A is the cross-sectional area of the pulse tube, and x is the axial distance from the cold end of the pulse tube.

8. A pulse tube according to claim 7, where the equation defines a radius at two locations within the pulse tube that are connected by a straight line to define a constant taper angle for the pulse tube.

* * * * *